US009539457B2

(12) United States Patent
Schwartz et al.

(10) Patent No.: US 9,539,457 B2
(45) Date of Patent: Jan. 10, 2017

(54) POLE VAULT LANDING SYSTEM CONFIGURED FOR RECEIVING A COLLAR

(71) Applicant: UCS, INC., Lincolnton, NC (US)

(72) Inventors: Jeffrey Schwartz, Alpine, NJ (US); Lawrence Howard Schwartz, Lincolnton, NC (US)

(73) Assignee: UCS, INC., Lincolnton, NC (US)

( * ) Notice: Subject to any disclaimer, the term of this patent is extended or adjusted under 35 U.S.C. 154(b) by 0 days.

(21) Appl. No.: 14/620,008

(22) Filed: Feb. 11, 2015

(65) Prior Publication Data

US 2015/0231435 A1 Aug. 20, 2015

Related U.S. Application Data

(60) Provisional application No. 61/940,731, filed on Feb. 17, 2014.

(51) Int. Cl.
*A63B 5/06* (2006.01)
*A63B 26/00* (2006.01)
*A63B 6/02* (2006.01)

(52) U.S. Cl.
CPC .. *A63B 6/02* (2013.01); *A63B 5/06* (2013.01)

(58) Field of Classification Search
CPC ..... A63B 5/00; A63B 5/06; A63B 6/00; A63B 6/02; A63B 6/025; A63B 1/22
USPC ..... 482/14, 15, 18, 142, 148
See application file for complete search history.

(56) References Cited

U.S. PATENT DOCUMENTS 2,110,254 A 3/1938 Austin
3,965,507 A * 6/1976 Reiland ..... A63B 6/02 482/15
4,163,551 A 8/1979 Simpson
4,245,838 A * 1/1981 Gordon ..... A63B 6/02 482/15
4,443,009 A * 4/1984 Smith ..... A63B 5/06 482/15

(Continued)

FOREIGN PATENT DOCUMENTS

DE 9306068.8 U1 10/1993
FR 2594343 A1 8/1987
GB 923243 A1 4/1963

OTHER PUBLICATIONS

Second Written Opinion for PCT/US2013/070143, dated Oct. 29, 2014.

(Continued)

*Primary Examiner* — Stephen Crow
*Assistant Examiner* — Garrett Atkinson
(74) *Attorney, Agent, or Firm* — Moore & Van Allen PLLC; W. Kevin Ransom

(57) ABSTRACT

Embodiments of the invention are directed to a pole vault landing system configured for receiving a pole vault box collar. The pole vault landing system may be comprised of a base section and a cutout section positioned adjacent to the base section, where both the base section and the cutout section have top and bottom surface. The bottom surface of the cut out section additionally comprises a recess dimensioned to receive a pole vault box collar such that when the cutout section is placed over a pole vault box and a pole vault box collar, the pole vault box collar is received in the recess and the bottom surface of the cutout section is substantially flush with the ground surrounding the pole vault box.

6 Claims, 5 Drawing Sheets

(56) References Cited

U.S. PATENT DOCUMENTS

| | | | | |
|---|---|---|---|---|
| 7,736,274 | B2 | 6/2010 | Thibodeaux, Sr. | |
| 8,444,531 | B1 | 5/2013 | Johnson et al. | |
| 2004/0053747 | A1 | 3/2004 | Bollinger | |
| 2004/0067820 | A1* | 4/2004 | Noble | A63B 5/06 482/18 |
| 2014/0135177 | A1* | 5/2014 | Schwartz | A63B 5/06 482/18 |

OTHER PUBLICATIONS

International Search Report and Written Opinion for PCT/US2013/070143, dated Feb. 19, 2014.
International Preliminary Report on Patentability (IPRP) for PCT/2013/070143 completed and mailed on Feb. 11, 2015.
Vault Box Collar, Gill Athletics, Inc., Champaign, Illinois, 61922. Retrieved from Internet URL: www.gillathletics.com/store/products.asnx?id=676 on Aug. 19, 2010.

* cited by examiner

POLE VAULT LANDING SYSTEM CONFIGURED FOR RECEIVING A COLLAR

CROSS REFERENCE TO RELATED APPLICATION(S)

This non-provisional application claims priority to U.S. Provisional Application No. 61/940,731 titled POLE VAULT LANDING AREA CONFIGURED FOR RECEIVING A COLLAR, which was filed Feb. 17, 2014; the contents of which are hereby incorporated herein by reference.

TECHNICAL FIELD

The invention relates generally to pole vault landing systems, and more specifically to a pole vault landing system configured for receiving a collar associated with a pole vault box.

BACKGROUND

Athletic Associations have recently mandated the use of collars that surround the outer perimeter of pole vaulting boxes. When placing an existing pole vault landing system (sometimes referred to as a pole vault landing pit) on top of the collar, a hazardous gap between the pole vault landing system and the ground is created due the landing system being leveraged from the ground because of interference with the bottom of the landing system and the height of the collar. Furthermore, pole vault pits/landing systems are known to slide during and/or after the vault box has been engaged by the athlete. The movement of the pole vault pit/landing system introduces an additional concern. There is a need to eliminate the movement of the pole vault pit/landing system and provide a flush surface between the pole vault pit/landing system and the ground surrounding the pole vault box.

BRIEF SUMMARY

In one aspect, the present invention is directed to pole vault landing system configured for receiving a collar associated with a pole vault box. The pole vault landing system may be comprised of a base section and a cutout section positioned adjacent to the base section, where both the base section and the cutout section have top and bottom surfaces. The bottom surface of the cut out section may additionally comprise a recess dimensioned to receive a pole vault box collar. When the pole vault landing system is placed above a pole vault box and a pole vault box collar, the pole vault box collar is received in the recess and the bottom surface of the cutout section is substantially flush with the ground surrounding the pole vault box.

In one embodiment, the cutout section of the pole vault landing system defines front and rear side walls connected by outer and inner side walls such that the recess extends into at least a portion of the inner side walls of the bottom surface of the cutout section.

In one embodiment, the recess is approximately 60 inches long, 48 inches wide, and 4 inches deep with respect to the ground level.

In one embodiment, upon installation of the pole vault landing system the recess positioned such that it horizontally aligns with the pole vault box collar.

In one embodiment, recess is defined by outer and inner rear side edges, outer left and outer right side edges, inner left and inner right side edges, and front left and front right side edges, wherein the outer left and outer right side edges are parallel to one another and separated by a distance Y.

In one embodiment, that the outer and inner rear side edges of the recess are parallel to one another and separated by a distance.

In one embodiment, the inner left and inner right side edges of the recess extend outwardly at an obtuse angle from left and right ends of the inner rear side edges, respectively, towards the front left and front right side edges, and wherein the left and right side edges connect at respective ends to ends of the outer left and right side edges, opposite the inner rear side edge, such that the recess forms a "U"-Shape.

In one embodiment, the inner left and right side edges extend to a position that is between a midsection of the front left and front right side edges and a respective end point of the respective front left and front right side edges that is opposite respective ends of outer left and right side edges.

BRIEF DESCRIPTION OF THE DRAWINGS

Figure 1:
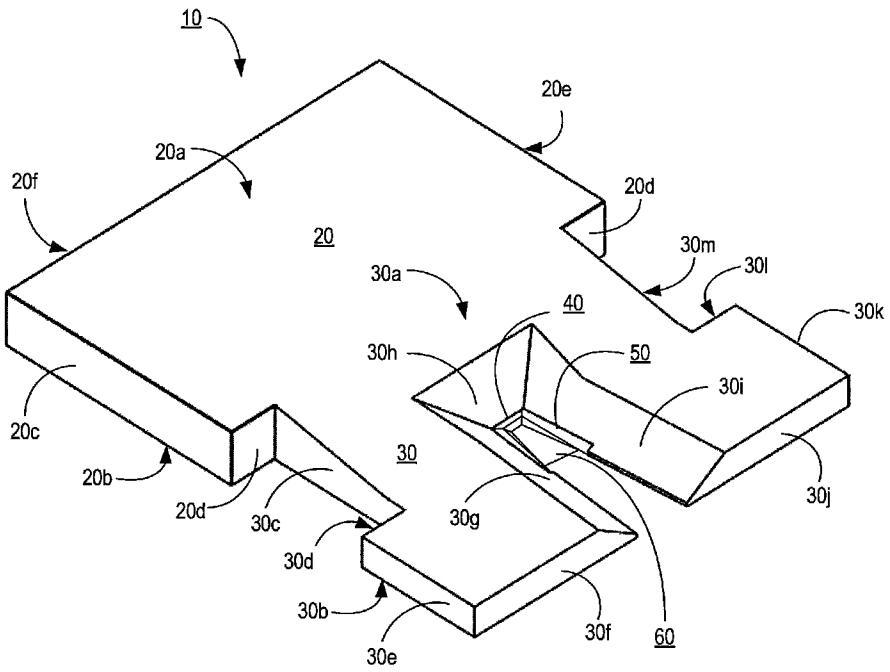
Figure 2:
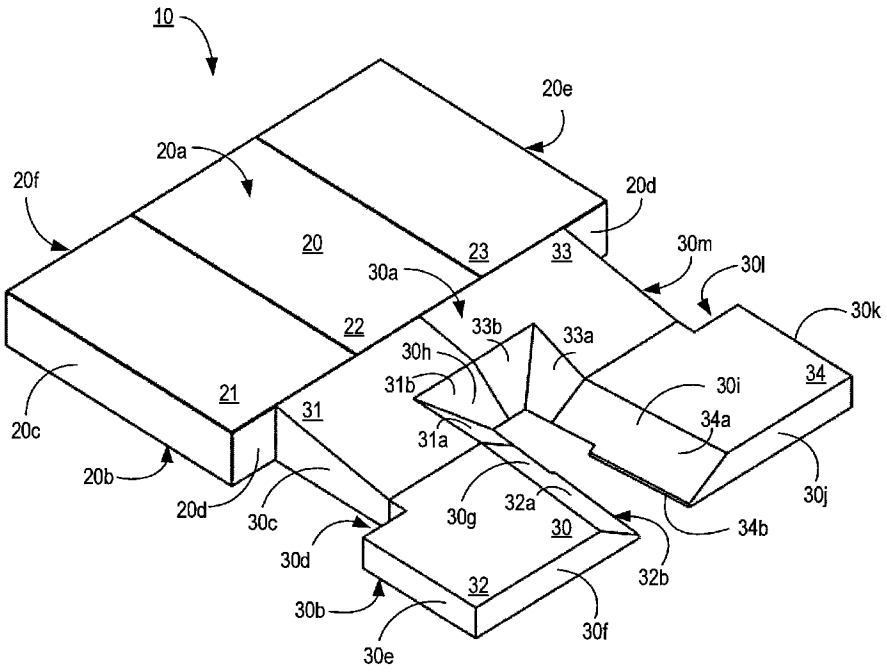
Figure 3A:
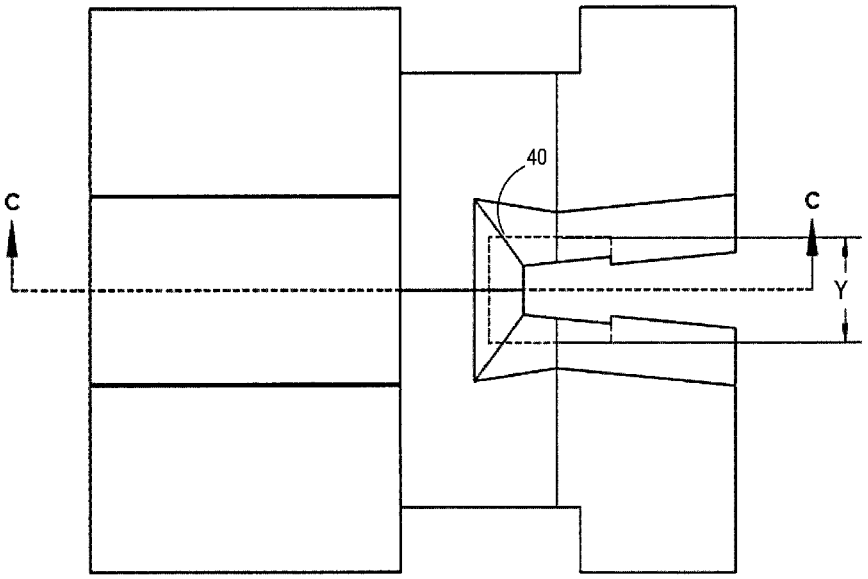
Figure 3B:
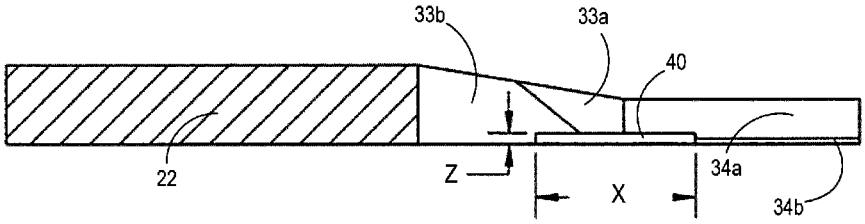
Figure 4:
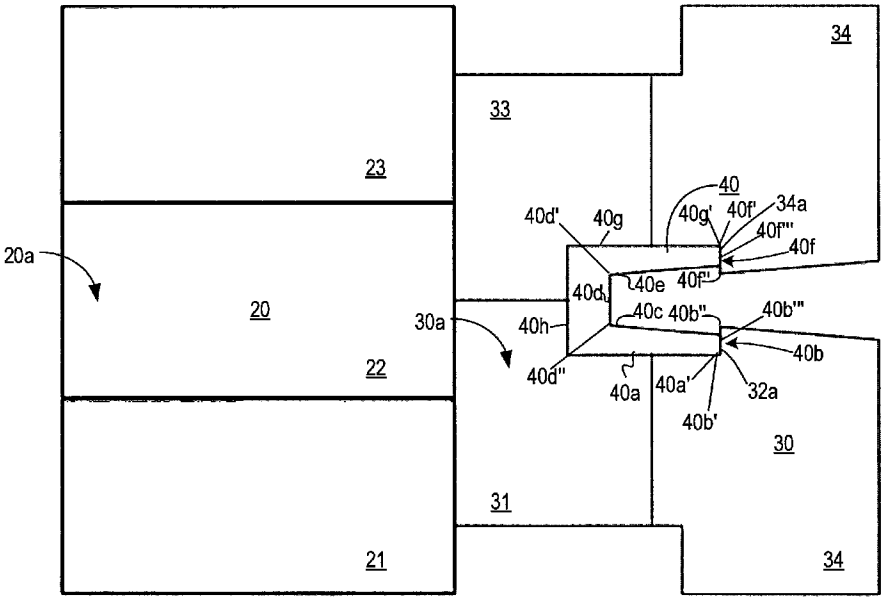
Figure 5:
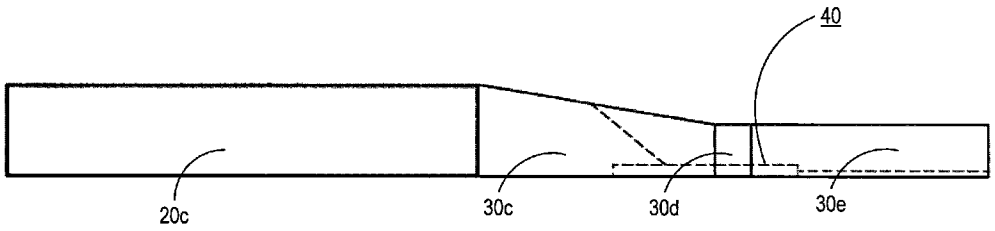

Having thus described embodiments of the invention in general terms, reference will now be made to the accompanying drawings, where:

FIG. 1 depicts a perspective illustration of a pole vault landing system, in accordance with an embodiment of the present invention;

FIG. 2 depicts a perspective illustration of the pole vault landing system of FIG. 1;

FIG. 3A depicts a top side view of the pole vault landing system of FIG. 1;

FIG. 3B depicts a cross-sectional view of the pole vault landing system of FIG. 1;

FIG. 4 depicts a bottom side view of the pole vault landing system of FIG. 1; and FIG. 5 depicts a left side view of the pole vault landing system of FIG. 1.

DETAILED DESCRIPTION OF EMBODIMENTS OF THE INVENTION

Embodiments of the present invention are described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

When an athlete undertakes a pole vault jump, he/she plants one end of a vaulting pole into a pole vault plant box while holding on to the opposite end of the vaulting pole. The vaulting pole, bending under force, catapults the athlete upwards into the air and over a horizontal bar, which, based on its height above ground, measures the height of the jump. After clearing the bar, the athlete lands safely on a soft landing area or pit located on an opposite side of the bar from that of the vault box. The landing area includes padding to cushion the athlete's fall and therefore minimize injury. The landing area is sized to align with the athlete, as they clear the horizontal bar. However, the landing area may not be designed to encompass other components of the pole vault box assembly, such as a pole vault box collar, or be configured to minimize movement of the landing area due to use by the pole vaulter. Added features that address these issues and others are discussed herein.

With reference to FIG. 1, the present invention relates to a pole vault landing system or pit 10 that is configured for receiving a pole vault box collar 50. The pole vault landing system 10 comprises, in general, two sections: 1) a rear base section 20 and 2) a cutout section 30. The rear base section 20 is provided for protecting an athlete after successfully clearing the bar and cushioning their fall after dismounting the vaulting pole, and the cutout section 30 is provided for extending the landing system outward from the vaulting box to further reduce the risk of injury to athletes caused by impact in and around the pole vault box 60. The pole vault landing system 10 padding may be constructed from foam, molded foam, or cushion and upholstered or covered with a fabric, which will contain the foam in its required shape while providing resistance to damage from impacts of the vaulting pole or the athlete's cleats. Thickness of the pole vault landing system 10 padding may range in height depending on the application.

As discussed herein, the pole vault landing system 10 may be defined as a layer of protective padding that is provided around the vaulting pole's planting surface so that an athlete's fall may be appropriately cushioned. Pole vault box padding rules in accordance with domestic and international pole vaulting regulations of the IAAF, NCAA, and other governing organizations, require all pole vault box collars to contain padding in and around the pole vault box collar, as required by the applicable ASTM specification standard (designation F2949-12), including on the part of the box collar arm that extends down the inner sidewall of the pole vault box (referred to in the ASTM specification as a "box collar wing"). Thus, the pole vault landing system 10 is generally positioned adjacent to at least a portion of the top surface of the pole vault box collar 50 that surrounds the pole vault box 60 and the ground surrounding the pole vault box 60.

In this regard, the pole vault landing system 10 of the present invention may comprise a recessed area 40 within the bottom surface of the cutout section 30 for receiving a pole vault box collar 50 such that when placed above the pole vault box collar 50 and the pole vault box 60 the bottom surface of the cutout section 30 is flush with the ground surrounding the pole vault box.

As illustrated in FIG. 1, the rear base section 20 may be defined by a top and bottom surface (20*a*,20*b*, respectively), and left, front, right, and rear side walls (20*c*-20*f*, respectively) wherein the front 20*d* and rear 20*f* side walls are connected by the left 20*c* and right 20*d* side walls so as to form a perimeter. Additionally, the top 20*a* and bottom 20*b* surfaces are defined within the perimeter. In one embodiment, the front 20*d*, rear 20*f*, left 20*c*, and right 20*e* sides are adjoined at their ends to form four (4) 90 degree angles such that the perimeter of the platform forms a square or rectangular shape such that the base section 20 is defined by a square or rectangular shaped cube. For example, in the embodiment illustrated in FIGS. 1 and 2, a first end of the front side wall 20*d* is adjoined to a second end of the left side wall 20*c* at a 90 degree angle to form one (1) of four (4) corners of the perimeter of the base section 20. Although in the illustrated embodiment, the base section 20 is defined by a rectangular shape it should be noted that the based section 20 may be constructed to conform to other shapes including, but not limited to, circles, triangles, polygons, organic/irregular shapes, and the like. A portion of the front side wall 20*d* of the base section 20 is positioned adjacent the rear side wall of the cutout section 30, and the bottom surface 20*b* is positioned adjacent to the ground.

In some embodiments, as illustrated in FIG. 2, the base section 20 may be divided into subsections. In the illustrated embodiment, the base section 20 is divided into a left, middle, and right subsection of base padding (21-23, respectively). The front side walls of the left, middle, and right subsections (21-23, respectively) are vertically adjacent to one another such that they collectively define the front side wall 20*d* of the base section 20. Thus, in an embodiment where the base section 20 is divided into subsections, the length of the front side wall 20*d* may be equivalent to the sum of the lengths of the front side walls of the subsections. Likewise, the rear side walls of the left, middle, and right subsections are vertically adjacent to one another such that they collectively define the rear side wall of 20*f* of the base section 20. Thus, in an embodiment where the base section 20 is divided into subsections, the length of the rear side wall 20*f* may be equivalent to the sum of the lengths of the rear side walls of the subsections. In the illustrated embodiment, the right side wall of the left subsection 21 is placed adjacent to the left side wall of the middle subsection 22, and the right side wall of the middle subsection 22 is placed adjacent to the left side wall of the right subsection 23 such that the top and bottom surfaces of the left, right, and middle subsections (21-23, respectively) collectively define the top and bottom surfaces (20*a*,20*b*, respectively) of the base section 20. Whereas, the left side wall 20*c* of the base section 20 is solely defined by (and/or equivalent to) the left side wall of the left subsection 21, and the right side wall 20*e* of the base section 20 is (and/or equivalent to) defined by the right side wall of the right subsection 23.

As further illustrated in FIG. 1, the cutout section 30 may be defined by a top and bottom surface (30*a*, 30*b*, respectively), first, second, and third outer left side walls (30*c*-30*e*, respectively), front left side wall 30*f*, inner left side wall 30*g*, inner rear side wall 30*h*, inner right side wall 30*i*, front right side wall 30*j*, first, second, and third outer right side walls (30*k*-30*m*), and an outer rear side wall, wherein the front sides walls (30*f*, 30*j*) and outer rear side wall are connected by the outer left (30*c*-30*e*), inner (30*g*-30*i*) and outer right (30*k*-30*m*) side walls so as to form a perimeter. Additionally, the top 20*a* and bottom 20*b* surfaces are defined within the perimeter. In one embodiment, the side walls are connected such that the perimeter of the cutout section 30 forms a "U" shape such that the cutout section 30 is defined by a three (3) dimensional "U"-shaped trapezoid. Although in the illustrated embodiment, the cutout section 30 is defined by a "U" shape it should be noted that the cutout section 30 may be constructed to conform to other shapes including, but not limited to, circles, triangles, polygons, organic/irregular shapes, and the like. In the illustrated embodiment, the inner side walls (30*g*-30*i*) extend upward and outward from the pole vault box 60 at an obtuse angle with respect to the ground level. It should be noted however, that the inner side walls may extend upward from the pole vault box at other angles including an acute angle and or such that it is defined by a straight edge with respect to the ground level.

In some embodiments, as illustrated in FIG. 2, the cutout section 30 may be divided into subsections. In the illustrated embodiment, the cutout section 30 is divided into a rear and front left subsection (31, 32, respectively) and a rear and front right subsection (33, 34, respectively) of padding. The rear side walls of the rear left and right subsections (31, 33, respectively) are vertically adjacent to one another such that they collectively define the rear side wall of the cutout section 30. Thus, in an embodiment where the cutout section 30 is divided into subsections, the length of the rear side wall of the cutout section 30 may be equivalent to the sum of the lengths of the rear side walls of the subsections.

The inner side walls of the rear and front left subsections (31*a*, 32*a*, respectively) are vertically adjacent to one another such that they collectively define the inner left side wall of 30*g* of the cutout section 30. In an embodiment where the cutout section 30 is divided into subsections, the length of the inner side wall 30*g* may be equivalent to the sum of the lengths of the inner side walls of the rear and front left subsections (31*a*, 32*a*, respectively). Likewise, the inner side walls of the rear and front right subsections (33*a*, 34*a*, respectively) are vertically adjacent to one another such that they collectively define the inner right side wall of 30*i* of the cutout section 30. In an embodiment where the cutout section 30 is divided into subsections, the length of the inner right side wall 30*i* may be equivalent to the sum of the lengths of the right side walls of the rear and front right subsections (33*a*, 34*a*, respectively). The inner side walls of the rear left and right subsections (31*b*, 33*b*, respectively) are vertically adjacent to one another such that they collectively define the inner rear side wall of 30*h* of the cutout section 30. In an embodiment where the cutout section 30 is divided into subsections, the length of the inner rear wall 30*h* may be equivalent to the sum of the lengths of the inner side walls of the rear left and right subsections (31*b*, 33*b*, respectively).

In the illustrated embodiment, the rear side wall of the front left subsection 32 is placed adjacent to the front side wall of the rear left subsection 31, the right side wall of the rear left subsection 31 is placed adjacent to the left side wall of the rear right subsection 33, and the front side wall of the rear right subsection 33 is placed adjacent to the rear side wall of the front right subsection 34 such that the top and bottom surfaces of the left and right subsections (31-33) collectively define the top and bottom surfaces (30*a*,30*b*, respectively) of the cutout section 30.

As illustrated in FIG. 2, the upper side wall 34*a* of the front right subsection 34 may be defined by a top, left, right, first and second bottom, and an extended side edge such that the lower side wall 34*b* of the front right subsection 34 extends downward towards ground level from the second bottom side edge of 34*a*. Likewise, the upper side wall 32*a* of the front left subsection 34 may be defined by a top, left, right, first and second bottom, and extended side edge such that the lower side wall 32*b* of the front left subsection 32 extends downward towards ground level from the second bottom side edge of 32*a*. In such an embodiment, the height of the recess 40 may be greater than the height of the lower side wall 32*b* where at least a portion of the recess 40 is defined by the recessed area between the first bottom side edge of the front right subsection 32 and the ground level.

As further illustrated in FIG. 2, in one embodiment, the inner left and right side walls (31*a*, 32*a*) of the rear subsections and the inner rear side walls (31*b*, 33*b*) of the rear subsection may be defined by top, bottom, left and right side edges where the length of the top side edges is greater than the length of the bottom side edges such that the left and right side edges extend from ends of the top side edges inward at an acute angle towards the ends of the bottom side edges such that the walls form a trapezoidal shape.

A portion of the outer rear side wall of the cutout section 30 is positioned adjacent the center of the front side wall 20*d* of the base section 20 where the length of the front side wall 20*d* of the base section is greater than the length of the outer rear side wall of the cutout section 20 such that at least a portion of the front side wall 20*d* of the base section 20 extends outwardly beyond the outer rear side wall of the cutout section on both the left and right sides. The bottom surface 30*b* of the cutout section 30 is positioned adjacent to the ground and at least a portion of the top surface or the pole vault box collar 50.

FIG. 3B provides a cross-sectional view of the cross-section C shown in FIG. 3A, as illustrated in FIGS. 3A and 3B. The inner most portion of the bottom surface 30*b* of the cutout section 30 comprises a recessed area 40 that extends into the bottom surface 30*b* of the cutout section 30. The addition of the recess 40 may allow the landing system to be configured for receiving a pole vault box collar 50 such that when placed over the pole vault box collar 50 and the pole vault box 60 the bottom surface of the cutout section 30 is substantially flush with the ground surrounding the pole vault box collar 50 and the pole vault box 60. As shown in FIGS. 1 and 2, in one embodiment, the recessed area 40 is "U" shaped and is positioned to horizontally align with the pole vault box collar 50.

As illustrated in FIG. 3B, the recessed area 40 may comprise set dimensions for the length, width, and depth (X, Y, Z respectively) such that an indentation equivalent to the length, width, and depth extends into the bottom surface 30*b* of the cutout section 30. In preferred embodiments, the recessed area 40 may be approximately 60 inches long, 48 inches wide, and 4 inches deep with respect to ground level. In one embodiment, the recessed area 40 is positioned in the center of the bottom surface 30*b* with respect to the width and length of the cutout section 30. In such an embodiment, the recessed area may be located beneath at least a portion of inner side walls (30*g*-30*i*) such that the recess extends into a portion of the bottom surface 30*b* that corresponds to the inner side walls (30*g*-30*i*), and such that the recess 40 is horizontally parallel to the ground level and extends from left to right through a portion of the inner rear side wall 33*b*, the entire inner rear side wall 33*a*, and a portion of the right side wall 34*a*. In one embodiment, the recessed area 40 is a dimension Z in depth with respect to ground level. In such an embodiment, the recessed area 40 may be located beneath at least a portion of the inner side walls (30*g*-30*i*) such that a recess extends a depth of dimension Z into the bottom surface 30*b* that corresponds to the inner side walls (30*g*-30*i*).

Now referring back to FIG. 2, in an embodiment where the upper side wall 34*a* of the front right subsection 34 is be defined by a top, left, right, first and second bottom, and an extended side edge such that the lower side wall 34*b* of the front right subsection 34 extends downward towards ground level from the second bottom side edge of 34*a*, the depth of the recess 40 may be greater than the height of the lower side wall 34*b* where at least a portion of the recess 40 is defined by the area between the first bottom side edge of the front right subsection 34 and the ground level. Likewise, in an embodiment where the upper side wall 32*a* of the front left subsection 34 is be defined by a top, left, right, first and second bottom, and an extended side edge such that the lower side wall 32*b* of the front left subsection 32 extends downward towards ground level from the second bottom side edge of 32*a*, the depth of the recess 40 may be greater than the height of the lower side wall 32*b* where at least a portion of the recess 40 is defined by the area between the first bottom side edge of the front right subsection 32 and the ground level. As illustrated in FIG. 3B, the recess and/or recessed area 40 may be positioned adjacent to the left side edge of the lower side wall 34*b* and, likewise, adjacent to the right side edge of the lower side wall 32*b*.

As illustrated in FIG. 4, the recess 40 may be defined by outer and inner rear side edges (40*h*, 40*d*, respectively), outer left and right side edges (40*a*, 40*g*, respectively), inner left and right side edges (40*c*, 40*e*, respectively), and front left and right side edges (40*b*, 40*f*, respectively). The outer left and outer right side edges (40*a*, 40*g*, respectively) are generally parallel to one another and separated by a distance Y. The outer and inner rear side edges (40*h*, 40*d*, respectively) are parallel to one another and separated by a distance that can be varied based on the application. The inner left and right side edges (40*c*, 40*e*) extend outwardly at an obtuse angle from the left 40*d*' and right 40*d*" ends of the inner rear side edge 40*d*, respectively, towards the front left and front right side edges (40*b*, 40*f*, respectively). The front left and right side edges (40*b*, 40*f*) additionally connect at respective ends (40*b*', 40*f*') to the ends (40*a*', 40*g*') of outer left and right side edges (40*a*, 40*g*) opposite the inner rear side edge, such that the recess 40 forms a "U"-Shape. In one embodiment, the inner left and right side edges (40*c*, 40*e*) extend to a position that is between a midsection (40*b*'", 40*f*'", respectively) of the front left and front right side edges (40*b*, 40*f*) and a respective end point (40*b*", 40*f*") of the respective front left and front right side edges (40*b*, 40*f*) opposite the respective ends (40*a*', 40*g*') of outer left and right side edges (40*a*, 40*g*).

As further illustrated in FIG. 4, the front left and right side edges (40*b*, 40*f*, respectively) are at least partially defined by the extended side edges of the right subsections upper side wall (32, 34, respectively) such that the extended side edges extend slightly beyond the front left and right side edges (40*b*, 40*f*, respectively) towards the center of the pole vault box 60. The outer rear side edge 40*h* is at least partially defined by the bottom edges of the inner rear left and right side walls (31*b*, 33*b*, respectively) where the length of the outer rear side edge 40*h* may be equivalent to the sum of the lengths of the bottom edges of the inner rear left and right side walls (31*b*, 33*b*, respectively). The outer left side edge 40*a* is at least partially defined by the bottom edge of the inner left side wall 31*a* and a portion of the bottom edge of inner left side wall 32*a* where the length of the outer left side edge 40*a* may be equivalent to the sum of the lengths of the bottom edge of the inner left side wall 31*a* and a portion of the bottom edge of inner left side wall 32*a*. The outer right side edge 40*g* is at least partially defined by the bottom edge of the inner right side wall 33*a* and a portion of the bottom edge of inner right side wall 34*a* where the length of the outer right side edge 40*g* may be equivalent to the sum of the lengths of the bottom edge of the inner right side wall 33*a* and a portion of the bottom edge of inner right side wall 34*a*.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A pole vault landing system comprising:

a base section; and a cutout section positioned laterally adjacent to the base section, the cutout section comprising a top and a bottom surface, the bottom surface of said cutout section comprising a recess extending into the bottom surface of said cutout section toward the top surface of said cutout section, wherein the recess is dimensioned to receive a pole vault box collar such that when the cutout section is placed over a pole vault box and over a pole vault box collar, the pole vault box collar is received in the recess in the cutout section and the bottom surface of the cutout section is substantially flush with the ground surrounding the pole vault box; wherein the recess is defined by outer and inner rear side edges, outer left and outer right side edges, inner left and inner right side edges, and front left and front right side edges, wherein the outer left and outer right side edges are parallel to one another and separated by a distance Y; wherein the outer and inner rear side edges of the recess are parallel to one another and separated by a distance; and wherein the inner left and inner right side edges of the recess extend outwardly at an obtuse angle from left and right ends of the inner rear side edges, respectively, towards the front left and front right side edges, and wherein the inner left and inner right side edges connect at respective ends to ends of the outer left and right side edges, opposite the inner rear side edges, such that the recess forms a "U"-Shape.

2. The pole vault landing system of claim 1, wherein the cutout section defines front and rear side walls connected by outer and inner side walls such that the recess extends into at least a portion of the bottom surface of the inner side walls of the cutout section.

3. The pole vault landing system of claim 2, wherein the cutout section comprises a front left lower side wall and a front right lower side wall, and wherein at least a portion of the recess is parallel to a second end of the front left lower side wall and a first end of the front right lower side wall.

4. The pole vault landing system of claim 1, wherein the recess is approximately 60 inches long, 48 inches wide, and 4 inches deep with respect to the ground level.

5. The pole vault landing system of claim 1, wherein upon installation of the pole vault landing system the recess is positioned such that it horizontally aligns with the pole vault box collar.

6. The pole vault landing system of claim 1, wherein the inner left and right side edges extend to a position that is between a midsection of the front left and front right side edges and a respective end point of the respective front left and front right side edges that is opposite respective ends of outer left and right side edges.

* * * * *